United States Patent [19]

Vetter

[11] 4,061,310

[45] Dec. 6, 1977

[54] LIFTING CUSHION FOR THE LIFTING, SUPPORTING AND MOVING OF HEAVY OBJECTS

[76] Inventor: Manfred Vetter, Burg Langendorf, Zulpich-Langendorf, Germany, 5351

[21] Appl. No.: 734,156

[22] Filed: Oct. 20, 1976

[30] Foreign Application Priority Data

Oct. 20, 1975 Germany ..... 7533295

[51] Int. Cl.[2] ..... B66F 3/24

[52] U.S. Cl. ..... 254/93 HP

[58] Field of Search ..... 254/DIG. 1, 93 HP

[56] References Cited

U.S. PATENT DOCUMENTS

| | | | |
|---|---|---|---|
| 2,297,556 | 9/1942 | Hermann | 254/DIG. 1 |
| 2,609,177 | 9/1952 | Hughes | 254/93 HP |
| 2,644,449 | 7/1953 | Champagne | 254/93 HP |
| 3,990,681 | 11/1976 | McKeen | 254/93 HP |

*Primary Examiner*—Robert C. Watson

*Attorney, Agent, or Firm*—Behr & Woodbridge

[57] ABSTRACT

A lifting cushion apparatus is equipped with a plurality of inflatable chambers at least one of which is adapted to have a wedge-like shape when inflated. The wedge chambers may be preformed through the use of wedge-shaped sidewalls and interior separators. Alternatively, the wedge chambers may be formed through the use of an external shaping means such as a string or band placed through a pair of separator bars in a zig-zag fashion. By employing at least four wedge chambers in the cushion apparatus it is possible to achieve at least seven discrete head tilt angles. The head plate of each of the cushion apparatuses is equipped with a coupling means so that two lifting cushion apparatus can be connected together in the tandem fashion. By the judicious placement of the lifting cushions it is possible to lift loads which have a low specific surface strength relative to their weights. Such loads would include, for example, airplanes, busses, tank cars, trucks, subway cars and the like.

14 Claims, 10 Drawing Figures

FIG. 7A.
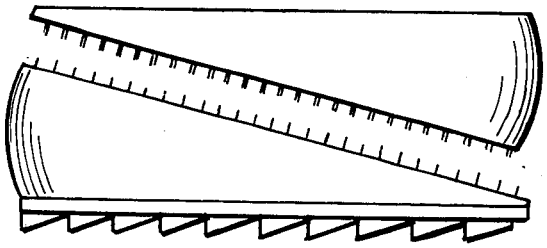
FIG. 7B.
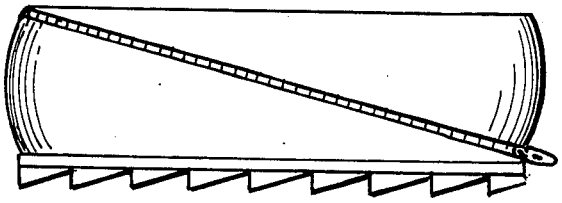
FIG. 7C.
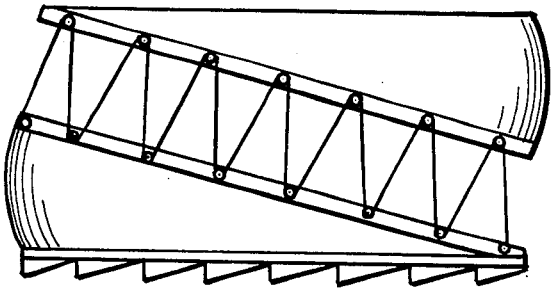
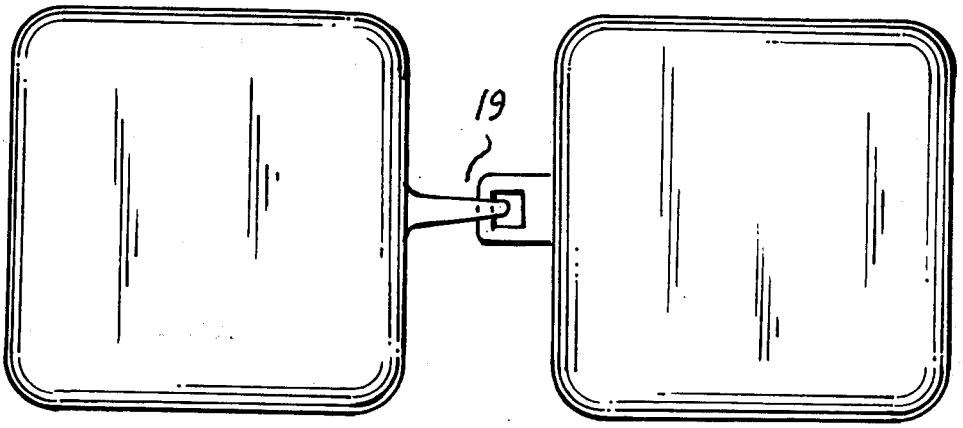
FIG. 8.

LIFTING CUSHION FOR THE LIFTING, SUPPORTING AND MOVING OF HEAVY OBJECTS

BACKGROUND OF THE INVENTION

1. Field of the Invention

This invention relates to a lifting cushion apparatus for lifting, supporting, or moving heavy loads and wherein the apparatus comprises a plurality of chambers at least one of which has a wedge-like shape when inflated.

2. Description of the Prior Art

Lifting cushions are known to those of ordinary skill in the art and have been used for the raising or supporting of loads which have a low specific surface strength relative to their weight. Such loads would include, but not be limited to the following examples: airplanes, busses, tank cars, trucks, subway cars, and the like. Prior art lifting cushions are generally cylindrical or cubic in form. The sidewalls of such cushions are frequently constructed of polyamide filament weave which has been made air-tight through the use of a coating of synthetic rubber or gum. The cushions are usually provided with an upper surface having a head plate thereon and a lower surface which is attached to a bottom plate. The head plate and the bottom plate of prior art lifting cushions typically have a flexible level-like consistency and are constructed to be resistant against deterioration which may be caused by oils or gasoline as well as being resistant to damage from pointed or sharp edged objects. It is also known in the prior art that the head plate and the bottom plate can be constructed of several layers of air-tight weave. A plurality of non-elastic bands may be provided between the head plate and the bottom plate in order to prevent them from bellying out during the inflation process.

The lifting cushions known in the prior art have the disadvantage that in the inflated condition the orientation of the head plate is substantially parallel to that of the base plate. Unfortunately, the head plate of such prior art lifting cushions cannot mold themselves sufficiently to the surfaces to be lifted or supported. For example, such cushions are not readily adapted to support cylindrical or rounded objects such as airplanes in an optimum manner. The prior art has attempted to overcome this disadvantage in some instances by providing the head plate with an additional foam cushion typically having an abrasion resistant covering. Unfortunately, it has been found that foam cushions of that sort have not substantially improved the effectiveness of the apparatus. It is, therefore, a purpose of the present invention to provide a lifting cushion which will give lifting support to surfaces which subtend an angle with respect to the plane on which the object rests.

SUMMARY OF THE INVENTION

Briefly described, the present invention comprises a lifting cushion including a plurality of inflatable chambers one located above the other in a stacked fashion. At least one of the chambers is a wedge chamber adapted to assume a wedge-like shape in the inflated condition. By inflating the wedge-shaped chamber it is possible to provide a better fit between the load to be raised and the head plate of the lifting cushion itself. According to one embodiment of the invention the lifting cushion is provided with at least two wedge chambers which are similar in shape but oriented in opposite directions. By this approach the lifting cushion can, by inflation of both chambers, provide a lifting cushion of the traditional type wherein the head plate is parallel to the base plate but additionally, by inflation of only one of the wedge chambers the head plate can be angled in two opposite orientations relative to the base plate.

In a further modification of the invention the lifting cushion may be provided with at least two chambers which when inflated provide a wedge shape wherein the wedges are oriented in the same direction, but wherein the wedge angle of each chamber is different. The wedge angle is defined as the angle subtended by the hypoteneuse of the wedge to its base. In this manner it is possible to orient the head plate in three different angles relative to the base plate. Thus, for example, if the wedge angle of one chamber is 15° and the wedge angle of the second chamber is 30°, it is therefore possible to orient the head plate at angles of 15°, 30° or 45° to the base plate depending upon whether either or both of the wedge chambers are inflated. Typically the wedge chambers have a rectangular, quadrilateral or round cross-section when cut in a plane parallel to the base plate. The wedge form of the chambers can be achieved by choosing chamber sidewalls of the appropriate form. In the embodiment wherein the cross-section of the lifting chamber is quadrilateral or rectangular it is possible to place two wedge-shaped chambers thereon with opposite orientations. It is also helpful to provide wedge shaped walls placed inside of the wedge chambers which tend to maintain the wedge form of the chamber when inflated. Alternatively, the wedge form can also be maintained through the use of appropriate shape holders. Suitably the cushion is adapted to provide for the use of the shape holder in such a fashion that the shape holder can be readily removed or installed.

The lifting cushion will also be subjected to forces which act parallel to the base plate. Therefore the lower surface of the base plate is equipped with knobs, ripples, studs, ribs and similar gripping devices which tend to increase the adhesion and traction between the bottom surface of the lifting cushion and the surface upon which it rests.

It is desirable to use at least two lifting cushions when raising a cylindrical type object such as an airplane. According to another embodiment of the present invention a coupling means is provided at the edges of the head plate. The coupling means is preferably located at the lower point of the wedge cushion. The coupling means allows the two edges of the head plates of two separate lifting cushions to be coupled together with the long axis of both lifting cushions parallel to each other so that the downward forces acting upon the respective head plates are equalized against their respective base plates.

These and other features of the present invention will be more fully understood with reference to the following drawings and description of the invention.

BRIEF DESCRIPTION OF THE DRAWINGS

FIG. 7*a* - 7*c* illustrate different manners by which inflatable wedge cushions may be temporarily fastened together.

FIG. 8 is a top plan view illustrating one manner in which two cushion apparatuses may be connected together.

DESCRIPTION OF THE INVENTION

During the course of this description like numbers will be used to illustrate like elements according to the different figures illustrating the invention.

Figure 1:
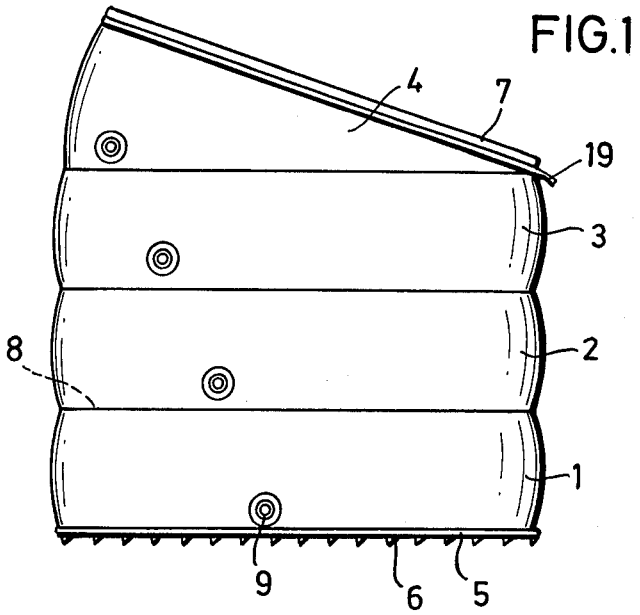
FIG. 1 is a side elevational view of a lifting cushion of the present invention shown in the inflated state with a wedge-shaped chamber on the top thereof.

As illustrated in FIG. 1, the lifting cushion comprises four separate inflatable chambers 1, 2, 3 and 4. The fourth chamber has a wedge-like shape and will be referred to in this description as either a wedge chamber or a wedge-shaped chamber. The bottom chamber 1 is provided with a base plate 5 which includes a plurality of retaining ridges 6. The upper surface of the top wedge chamber 4 is covered with a head plate 7 on which is located a layer of foam material. Suitable foam materials are known to those of ordinary skill in the art.

Each inflatable chamber 1, 2, 3 and 4 is provided with an air invention valve 9. The air insertion valves 9 are laterally staggered and displaced so that the lifting cushion can be collapsed into the minimum amount of space without interference from the stacking of the valve element.

Figure 2:
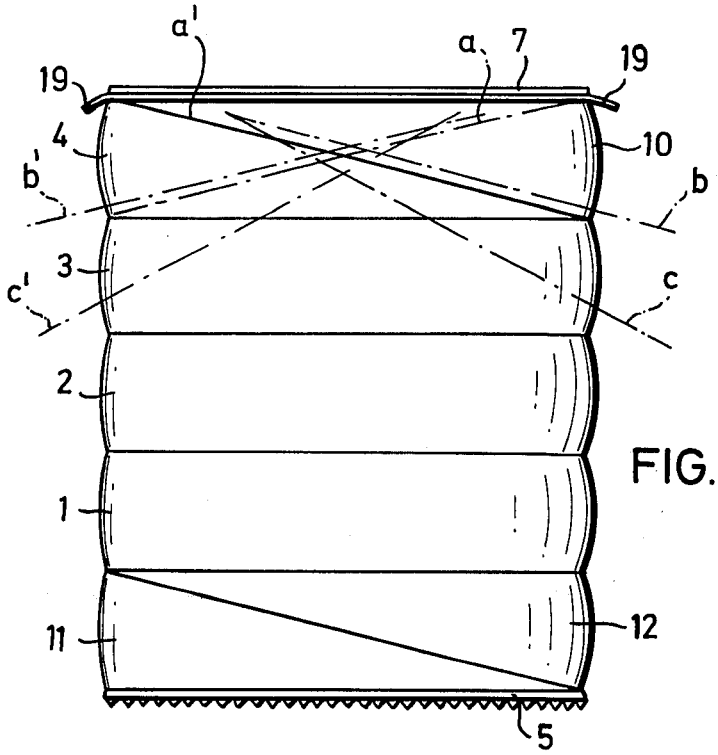
FIG. 2 is a side elevational view of an inflated lifting cushion of the present invention in which four wedge-shaped chambers are illustrated in inflated condition.

The embodiment of the lifting cushion illustrated in FIG. 2 includes seven inflatable chambers of which chambers 4, 10, 11 and 12 are wedge chambers. Each of the four chambers can be inflated separately or in selective combinations with the other three wedge chambers. Accordingly, it is possible to cause the head plate 7 to be brought into seven different positional orientations as illustrated by dotted lines A, B and C in one orientation and similarly by dotted lines A', B' and C' in the opposite direction. The seventh position, of course is the position in which the head plate 7 is parallel to the base plate 5.

Figure 3:
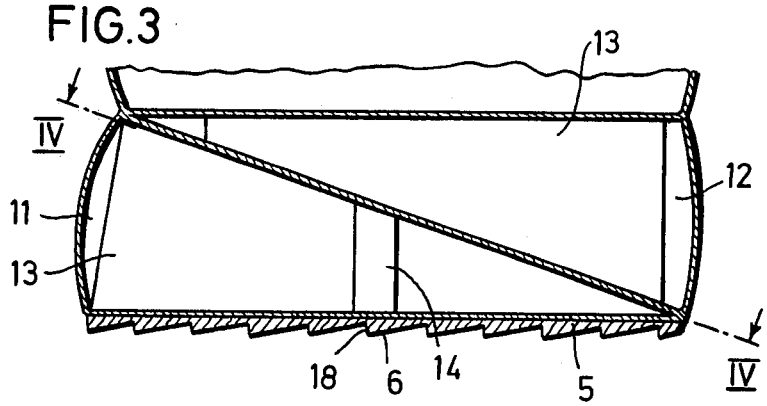
FIG. 3 is a vertical cross-section through the two bottom chambers illustrated in FIG. 2.
Figure 4:
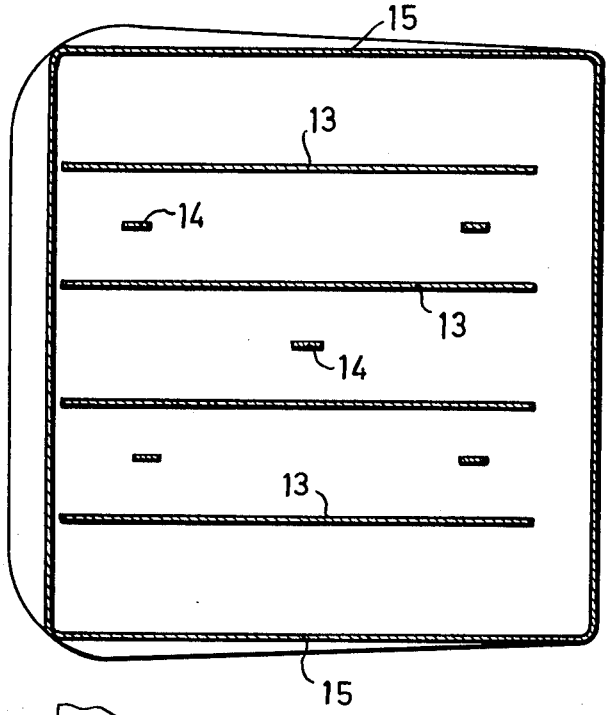
FIG. 4 is a cross sectional view of FIG. 3 along section line IV—IV.

The wedge shaped chambers 11 and 12 are provided with perpendicular expanding walls which function as separators and provide chambers 11 and 12 with their wedge shape. This embodiment of the present invention is clearly illustrated in FIGS. 3 and 4. Additionally, or in place of the walls 13, the lower surface of the lifting cushion can be provided with band shaped separators 14. When the lifting cushions have a rectangular or quadrilateral cross-section, sidewalls 15 of adjacent chambers 11 and 12 are similarly cut into a wedge shape.

Figure 5:
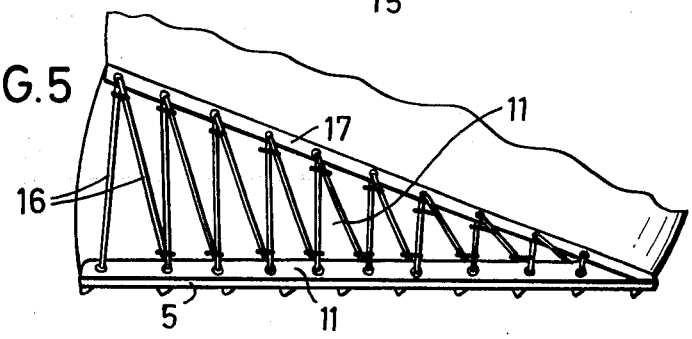
FIG. 5 is a side elevational view of a wedge-shaped inflatable chamber with an external variable wedge angle determining means attached thereto.

As illustrated in FIG. 5, the wedge shape of chamber 11 can also be obtained by providing the separator surfaces 8 and either the head plate 7 or the base plate 5 with bars 17 having eyelets provided therein which may be adjusted to the desired angular orientation by the appropriate application of retaining strings. The retaining strings 16 lace back and forth between the bars 17 in a zig-zag fashion and may be adjusted in the same manner that an individual ties his shoes. Alternatively, restraining bands can be used in place of strings.

Figure 6:
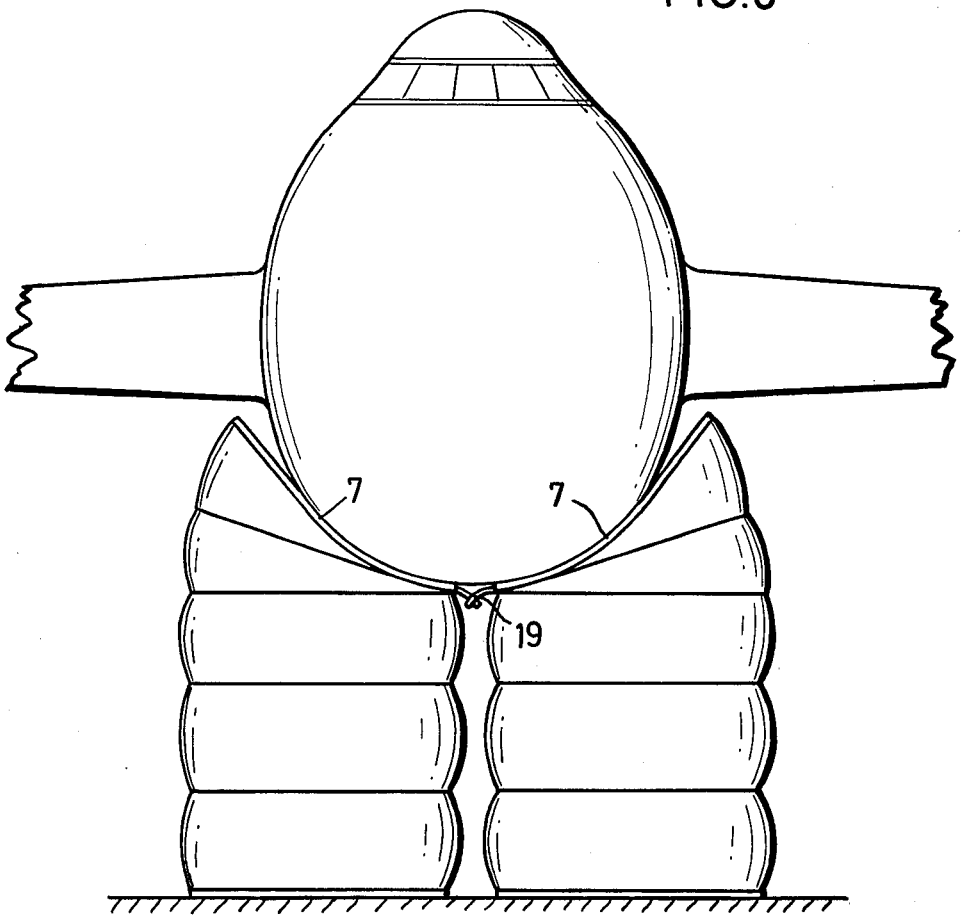
FIG. 6 illustrates a pair of lifting cushions according to the teaching of the present invention as utilized to support a grounded aircraft.

The use of lifting cushions for the purpose of supporting the noses of airplanes is illustrated in FIG. 6. The lifting cushions might be employed for repair purposes, for example. In FIG. 6 the two lifting cushions are provided with bars 19 having eyelets therein so that they may couple together in such a manner that the angularly oriented head plates 7 tilt towards each other. Since head plates 7 are not rigid, they tend to naturally conform somewhat to the curvature of the airplane nose. There are other coupling means which are known to those of ordinary skill in the art which could be used to replace the bars 19 illustrated in FIG. 6. For example the coupling means could include other hooks and eyes as well as zipper fasteners and the like. FIG. 8 illustrates the manner in which two cushion apparatuses such as illustrated in FIG. 6 may be connected by a pair of coupling bars 19 one of which has an eyelet therein. There are, however, numerous other mechanisms by which two cushions could be connected together.

One important feature of the invention is that it is possible in some embodiments to separate the wedge cushions. In FIG. 7*a* two separate wedge cushions are connected with Velcro® type fastening means. One cushion includes a plurality of loops and the other cushion includes a plurality of complementary hook-type elements. Alternatively, as shown in FIG. 7*b* the two wedge cushions could be temporarily fastened together by a zipper type means.

In FIG. 7*c* two wedge cushions are shown connected together by a zig-zag string means which laces between two opposing bars on each of the two cushions. Other types of attachments would be possible within the scope of the invention.

Since each separate chamber is at least partially independent of the other chambers, it is possible to inflate the lower chambers to a greater pressure than the other chambers. By utilizing such pressure differentials, it is therefore possible to provide the cushion as a whole with a greater structural stiffness without at the same time subjecting the actual supporting surface of the object to an unacceptably high pressure. It is also within the scope of the present invention that each chamber be provided with a means for rapidly removing the air therefrom so that the cushion can be quickly collapsed and folded together.

According to the preferred embodiment of the present invention the lifting cushions would have dimensions of up to 3 meters in length and breadth in the inflated state. However, the invention is by no means limited to such dimensions. In view thereof, it may be desirable to provide the head plate, the base plate and also the middle sections of the cushions with loops so that the lifting cushion can be readily handled and manipulated. Also, according to the preferred embodiment of the present invention it has been found that 0.5 bars above atmospheric pressure is an acceptable pressure for the inflated chambers. Naturally, other pressures could be used depending upon the weight of the object being supported and the strength of the materials employed in the lifting cushion.

While the invention has been described with reference to a preferred embodiment thereof, it will be clear to those of ordinary skill in the art that various modifications can be made in the invention and the parts thereof without departing from the spirit and scope of the invention.

What is claimed:

1. A lifting cushion apparatus having a top and bottom, said apparatus comprising:

a base plate for supporting said apparatus, said base plate including a bottom surface equipped with traction means thereon;

a plurality of inflatable chambers each located one above the other, at least one of said chambers comprising a first wedge chamber which will assume a wedge-like shape when inflated, said wedge chamber having a narrow end and a thick end;

at least two independent inflation valve means for independently inflating at least two of said chambers; and, a flexible head plate attached to the top of said apparatus and adapted to mold itself to the contour of the surface of the object to be lifted.

2. The apparatus of claim 1 further including:

at least a second wedge chamber similar to said first wedge chamber and attached to said first chamber to form a first pair therewith, said second wedge chamber being oriented with its narrow end adjacent the thick end of said first wedge chamber and the thick end of said second wedge chamber being adjacent to the narrow end of said first wedge chamber.

3. The apparatus of claim 2 further including:

a second pair of wedge chambers, wherein one pair of wedge chambers is located below said base plate near the top of said cushion apparatus and the second pair of wedge chambers is located near the bottom of said apparatus but above said base plate.

4. The apparatus of claim 1 wherein said lifting cushion apparatus includes at least two wedge chambers adapted to assume wedge-like shapes with two different wedge angles.

5. The apparatus of claim 1 further including:

a separable fastening means for connecting at least one of said wedge chambers to the remaining chambers and for selectively disconnecting said wedge chamber from the remaining chambers.

6. The apparatus of claim 1 wherein said traction means comprises a plurality of protuberances.

7. The apparatus of claim 1 wherein said head plate is disposed to slope at an angle with respect to said base plate, and wherein said apparatus further includes:

a coupling means attached to the lower edge of said sloping head plate for attaching said cushion apparatus to another cushion apparatus which has a similar coupling means.

8. The apparatus of claim 1 wherein said wedge chambers are provided with interior separator walls.

9. The apparatus of claim 1 wherein said wedge chambers are provided with an external shaping means for maintaining said chamber in a wedge-like shape.

10. The apparatus of claim 9 wherein said external shaping means is adjustable.

11. The apparatus of claim 9 wherein said external shaping means comprises a string-like means.

12. The apparatus of claim 9 wherein said external shaping means comprises a band-like means.

13. The apparatus of claim 9 wherein the wedge chamber includes adjacent forming walls which are provided at the edges thereof with a bar means having eyelets therein, said bar means being connected together with a string-like means in a zig-zag fashion.

14. A lifting cushion apparatus comprising:

a plurality of inflatable cushions, each located one above the other, at least one of said cushions comprising a wedge chamber which will assume a wedge-like shape when inflated;

an external shaping means for maintaining said wedge chamber in a wedge-like shape, wherein said wedge chamber includes adjacent forming walls which are provided at the edges thereof with a bar means having eyelets therein, said bar means being connected together with a string-like means in a zig-zag fashion.

* * * * *